US012714178B2

(12) United States Patent
Lind et al.

(10) Patent No.: US 12,714,178 B2
(45) Date of Patent: Aug. 25, 2026

(54) FOOTWEAR HAVING COVERED MIDSOLE AND METHODS OF MANUFACTURING THE SAME

(71) Applicant: adidas AG, Herzogenaurach (DE)

(72) Inventors: Mark Thomas Lind, North Hollywood, CA (US); John Matthew Wakefield, Portland, OR (US); Jared Kilmer, Vancouver (CA)

(73) Assignee: adidas AG, Herzogenaurach (DE)

( * ) Notice: Subject to any disclaimer, the term of this patent is extended or adjusted under 35 U.S.C. 154(b) by 154 days.

(21) Appl. No.: 16/815,714

(22) Filed: Mar. 11, 2020

(65) Prior Publication Data

US 2021/0282501 A1 Sep. 16, 2021

(51) Int. Cl.
*A43B 1/04* (2022.01)
*A43B 23/07* (2006.01)

(52) U.S. Cl.
CPC ..... *A43B 1/04* (2013.01); *A43B 23/07* (2013.01)

(58) Field of Classification Search
CPC ..... A43B 23/0235; A43B 23/0255
See application file for complete search history.

(56) References Cited

U.S. PATENT DOCUMENTS 1,798,248 A * 3/1931 Feinstein ..... A43B 23/28 12/146 CK
2,197,102 A * 4/1940 Edwards ..... A43C 11/006 36/45
4,599,810 A * 7/1986 Sacre ..... A43B 23/0255 36/83
6,154,983 A * 12/2000 Austin ..... A43B 13/28 36/12
6,167,640 B1 * 1/2001 Schaefer ..... A43B 23/07 36/98
9,498,022 B2 11/2016 Ikenaka et al.
9,968,156 B2 5/2018 Huffman et al.
10,098,411 B2 10/2018 Hoffer et al.
10,327,498 B2 * 6/2019 Burch ..... A43B 9/00
10,609,980 B2 * 4/2020 Weidl ..... A43B 5/18
2001/0049889 A1 * 12/2001 Chen ..... A43B 7/125 36/55
2003/0015822 A1 * 1/2003 Rinehart, Jr. ..... A43B 9/02 264/244
2004/0163280 A1 * 8/2004 Morris ..... A43B 9/00 36/28
2005/0055843 A1 * 3/2005 Morlacchi ..... A43B 7/125 36/44
2006/0248751 A1 * 11/2006 Haimerl ..... A43B 9/00 36/83
2008/0086793 A1 * 4/2008 Higgins ..... A42B 1/248 2/209.13

(Continued)

FOREIGN PATENT DOCUMENTS

CN 202286527 U 7/2012
EP 3048195 A1 1/2016

*Primary Examiner* — Grady Alexander Nunnery
(74) *Attorney, Agent, or Firm* — Sterne, Kessler, Goldstein & Fox P.L.L.C.

(57) ABSTRACT

An article of footwear includes a bootie configured to enclose a wearer's foot, and a midsole secured to the bootie. The article of footwear further includes a knit upper secured on the bootie. The knit upper covers an exterior surface of the bootie and the midsole.

13 Claims, 9 Drawing Sheets

(56) References Cited

U.S. PATENT DOCUMENTS

| | | | | |
|---|---|---|---|---|
| 2008/0110049 | A1* | 5/2008 | Sokolowski | D04B 1/22 36/50.1 |
| 2011/0162239 | A1* | 7/2011 | Bier | A43B 7/08 36/3 B |
| 2014/0165422 | A1* | 6/2014 | Pfister | D04B 21/16 36/45 |
| 2015/0342261 | A1* | 12/2015 | Boucher | A41B 11/007 12/142 G |
| 2017/0129200 | A1 | 5/2017 | Adami et al. | |
| 2018/0103719 | A1* | 4/2018 | Chen | B29D 35/126 |
| 2018/0295940 | A1 | 10/2018 | Bastianelli | |
| 2018/0317606 | A1 | 11/2018 | Schneider et al. | |
| 2018/0343974 | A1* | 12/2018 | Hancock | A43B 23/07 |
| 2019/0116932 | A1* | 4/2019 | Bell | A43B 23/025 |
| 2019/0208862 | A1* | 7/2019 | Poegl | A43B 1/04 |
| 2019/0223543 | A1 | 7/2019 | Tamm et al. | |
| 2020/0237047 | A1* | 7/2020 | Issler | G01M 3/103 |

* cited by examiner

FOOTWEAR HAVING COVERED MIDSOLE AND METHODS OF MANUFACTURING THE SAME

FIELD

Embodiments described herein generally relate to a method for forming an article of footwear. Specifically, embodiments described herein relate to a method for forming an article of footwear having an upper that at least partially covers a midsole of the footwear.

BACKGROUND

Articles of footwear generally include an upper that covers and encloses the wearer's foot and a sole on which the wearer's foot rests. The sole may include a midsole that provides cushioning and support to the wearer's foot and an outsole that is the ground-engaging surface of the footwear that provides traction and durability. The performance of the article of footwear can be customized based on how the upper, midsole and sole are constructed and what materials are used to construct these components. The manner in which the components are connected is another factor that may impact the performance of the resulting article of footwear.

The materials and methods of manufacturing the individual components of the footwear may also impact the overall cost and time required to manufacture the footwear. It is generally desirable to manufacture footwear with the desired performance characteristics while reducing the time and expense of the manufacturing process.

Thus, improved methods for manufacturing articles of footwear with the desired performance characteristics while limiting the time and expense of manufacturing the footwear are desired.

BRIEF SUMMARY OF THE INVENTION

Some embodiments described herein relate to an article of footwear that includes a bootie configured to enclose a wearer's foot, a midsole secured to the bootie, and a knit upper secured on the bootie such that the knit upper covers an exterior surface of the bootie and the midsole.

In any of the various embodiments described herein, the article of footwear may further include an outsole secured to the midsole. In some embodiments, the knit upper may be secured between the midsole and the outsole.

In any of the various embodiments described herein, the knit upper may be secured to the bootie by seam tape. In some embodiments, the seam tape may be stitched to the bootie.

In any of the various embodiments described herein, the bootie may include a heel region, and the midsole may extend onto the heel region of the bootie.

In any of the various embodiments described herein, the knit upper may include elastic yarn. In some embodiments, the knit upper may have a first zone and a second zone each including elastic yarn, and the first zone may have a higher proportion of elastic yarn than the second zone.

In any of the various embodiments described herein, the knit upper may fully cover the midsole.

In any of the various embodiments described herein, the knit upper may fully cover the exterior surface of the bootie.

Some embodiments described herein relate to an article of footwear that includes a bootie configured to enclose a wearer's foot, and a midsole secured to an underside of the bootie. The article of footwear may further include a knit upper secured on the bootie by seam tape such that the knit upper covers an exterior surface of the bootie and the midsole, and an outsole affixed to the midsole, wherein the outsole is configured to serve as a ground-engaging surface.

In any of the various embodiments described herein, a portion of the knit upper may be secured between the midsole and the outsole.

In any of the various embodiments descried herein, the knit upper may include elastic yarn.

Some embodiments described herein relate to method of forming an article of footwear, the method including arranging a bootie on a last, securing a knit upper on the bootie using seam tape to form an upper unit, securing a midsole to the upper unit, covering the bootie and the midsole with the knit upper such that the midsole is not visible from an exterior of the footwear, and securing an outsole to the midsole.

In any of the various embodiments described herein, the knit upper may be flat knit, and a method of forming an article of footwear may further include securing opposing sides of the knit upper to one another by a seam at a heel region of the article of footwear.

In any of the various embodiments described herein, the knit upper may include an elastic yarn, and covering the bootie and the midsole with the knit upper may include stretching the knit upper around the midsole.

In any of the various embodiments described herein, a method of forming an article of footwear may further include stitching the seam tape of the upper unit to the bootie.

In any of the various embodiments described herein, the midsole may be secured to the bootie by an adhesive.

In any of the various embodiments described herein, a method of forming an article of footwear may further include forming a recessed slot in the knit upper.

In any of the various embodiments described herein, a method of forming an article of footwear may further include securing a portion of the knit upper between the midsole and the outsole when the outsole is secured to the midsole.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Reference will now be made in detail to representative embodiments illustrated in the accompanying drawing. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

References in the specification to "one embodiment," "an embodiment," "an example embodiment," etc., indicate that the embodiment described may include a particular feature, structure, or characteristic, but every embodiment might not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Articles of footwear are often formed with a Strobel board that facilitates attachment of the upper to the midsole. However, a Strobel board may be fairly rigid and inflexible. As a result, the Strobel board may detract from the comfort and cushioning of the footwear, and may reduce the flexibility of the footwear. Further, heavy gluing steps may be required to secure the Strobel board to the midsole and to the upper. Therefore, there is a need in the art for footwear formed without the use of a Strobel board to allow for greater flexibility and underfoot cushioning.

Some embodiments described herein relate to an article of footwear formed by securing a knit upper to a bootie configured to receive a wearer's foot. In this way, the footwear can be formed without the use of a Strobel board, as the bootie can be used to connect the knit upper and the midsole. Some embodiments described herein relate to an article of footwear having a knit upper that covers a midsole of the footwear so as to provide footwear with a unique and substantially seamless appearance.

Figure 1:
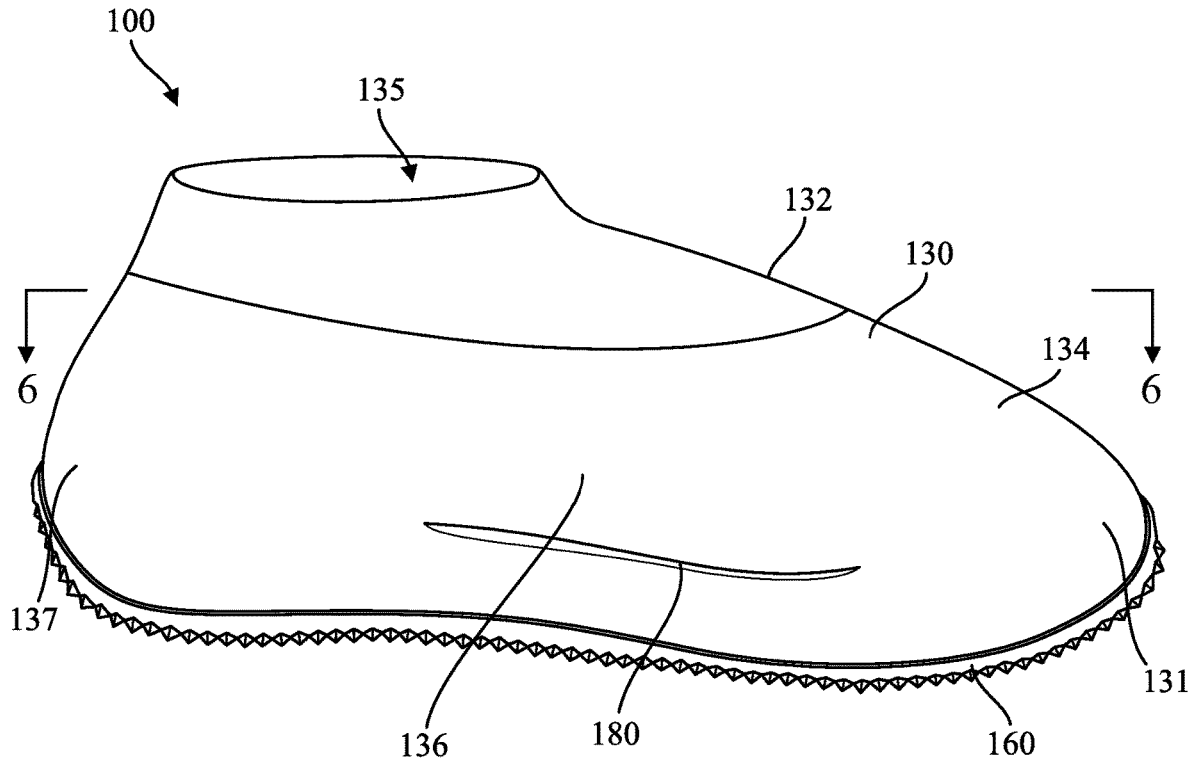
FIG. 1 shows a side perspective view of an article of footwear according to an embodiment.

Some embodiments described herein relate to an article of footwear 100 having an upper 130 as shown for example in FIG. 1. Article of footwear 100 may include an upper 130 that serves as the outermost layer of article of footwear 100. Upper 130 may cover a bootie and a midsole of article of footwear 100 so that the bootie and the midsole are not visible from an exterior of article of footwear 100. In this way, footwear 100 provides a unique appearance and no dividing line or seam is shown between the upper and the midsole with only upper 130 and an outsole 160 visible from an exterior of footwear 100.

Figure 2:
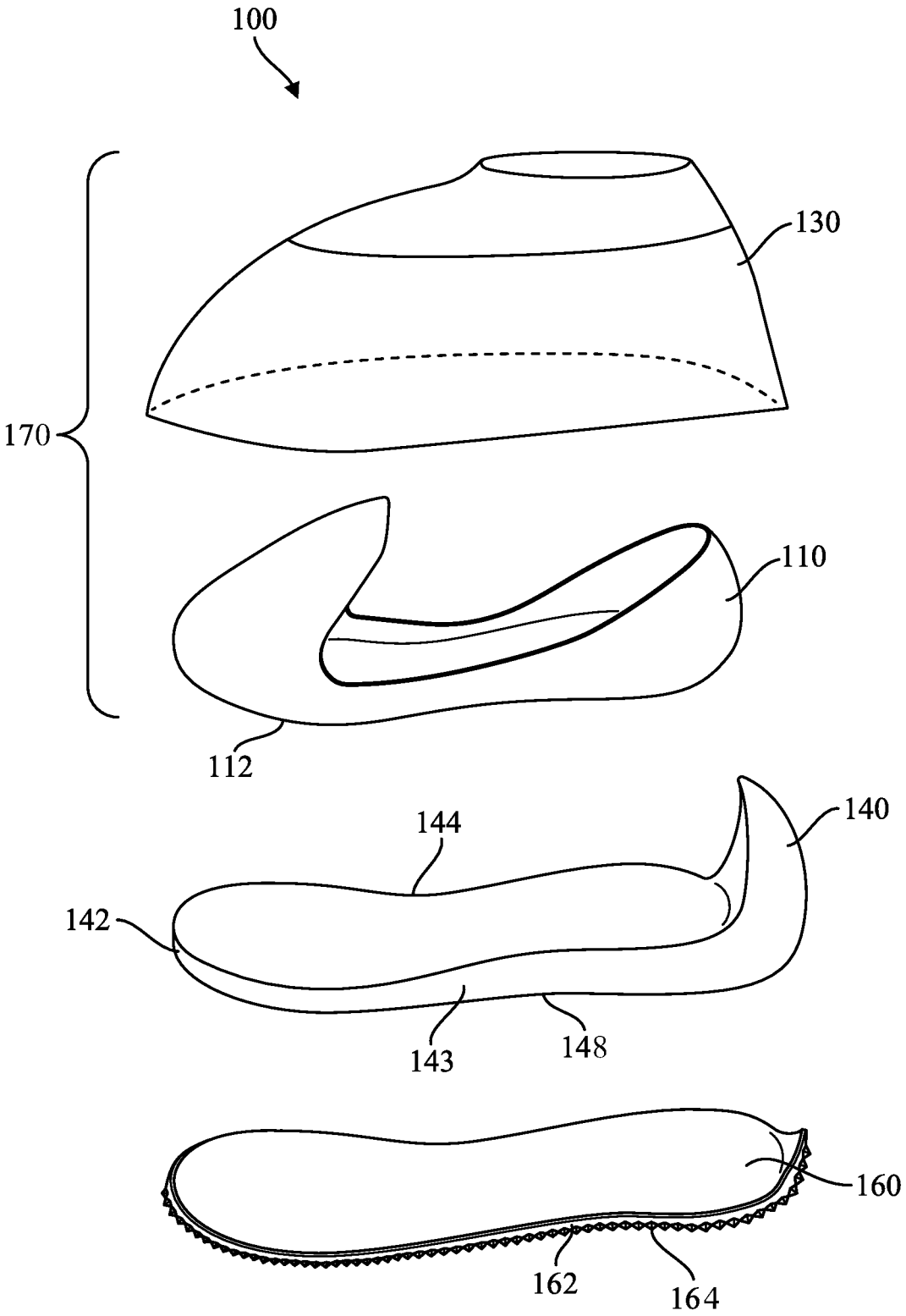
FIG. 2 shows an exploded view of the article of footwear of FIG. 1.

Footwear 100 may include an upper 130 that is secured to a bootie 110 that encloses the wearer's foot, as best shown in FIG. 2. The upper 130 secured to bootie 110 may be referred to as the upper unit 170. A midsole 140 may be secured to upper unit 170, such beneath a lower portion 112 of bootie 110. As no Strobel board is used, upper 130 may be secured to a lower surface 148 of midsole 140 such that upper 130 at least partially covers midsole 140. An outsole 160 may be secured to a lower surface 148 of midsole 140, such that a portion of upper 130 is secured between midsole 140 and outsole 160. Outsole 160 may serve as a ground-engaging surface of footwear 100 and may include treading 164 on its lower surface 162.

Upper 130 of footwear 100 may be made of a variety of materials, such as a textile fabric, woven good, non-woven good, knit good, mesh, leather, synthetic material, or a film product (e.g., a thermoplastic film), among others, and combinations thereof. Upper 130 may include a single layer, or a multi-layer construction. Upper 130 may further include a single piece of material, such that upper 130 has a unitary construction, or upper 130 may be formed from multiple pieces of material joined together. In embodiments in which upper 130 is formed from multiple pieces, each piece may include the same or a different material.

Figure 3:
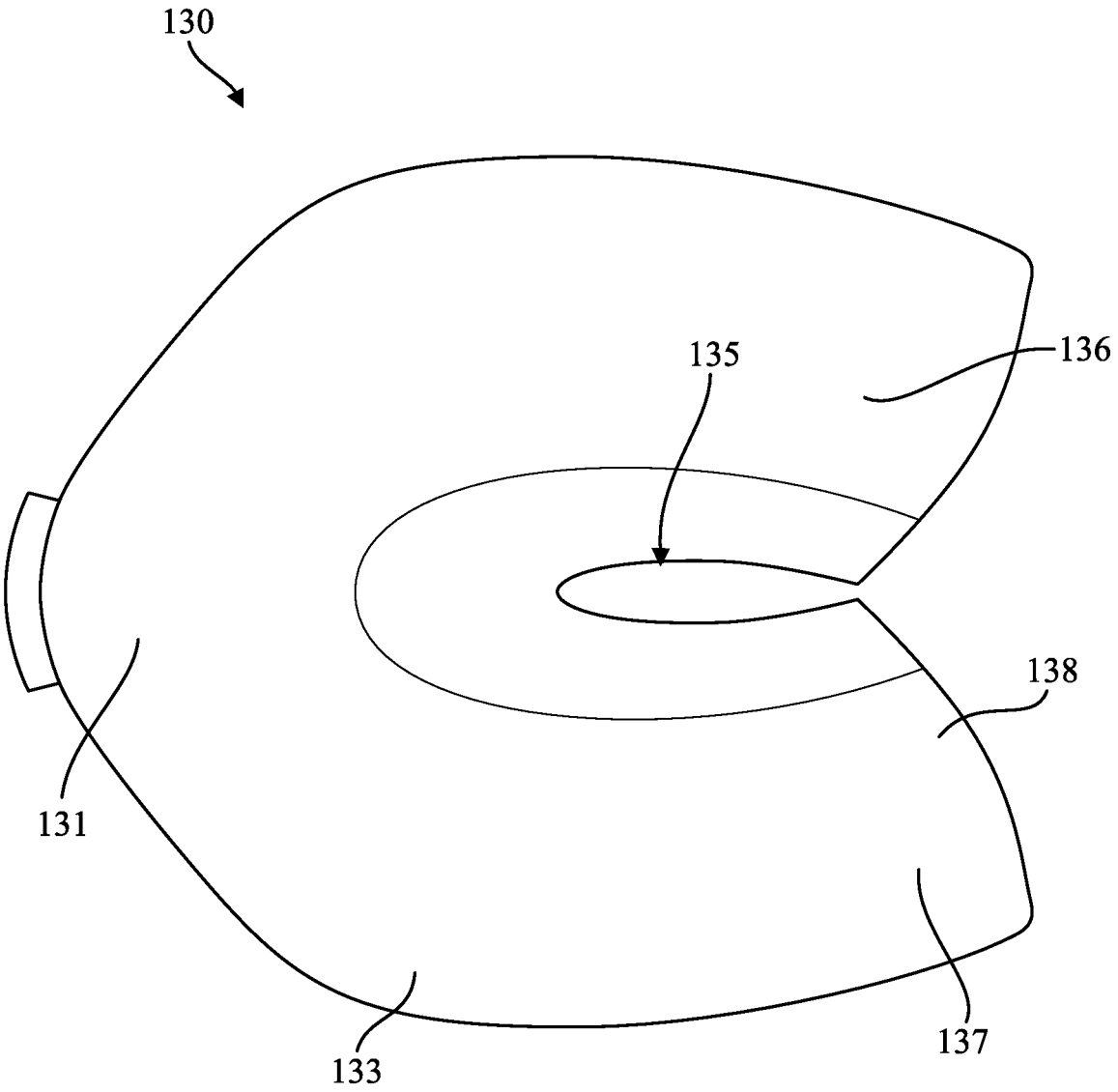
FIG. 3 shows a top down view of a knit upper for an article of footwear according to an embodiment.

In some embodiments, upper 130 of footwear 100 may be a knit upper 130, and may be formed by flat knitting. A flat knit upper used to form footwear 100 is shown for example in FIG. 3. However, in some embodiments, upper 130 may be formed by circular knitting. Knit upper 130 may be formed as a single piece so as to have a unitary construction. Upper 130 may include a front or toe region 131 opposite a rear or heel region 137. Upper 130 may include a medial side 136 and a lateral side 138, and an ankle opening 135 may be defined between the medial and lateral sides 136, 138.

Figure 4:
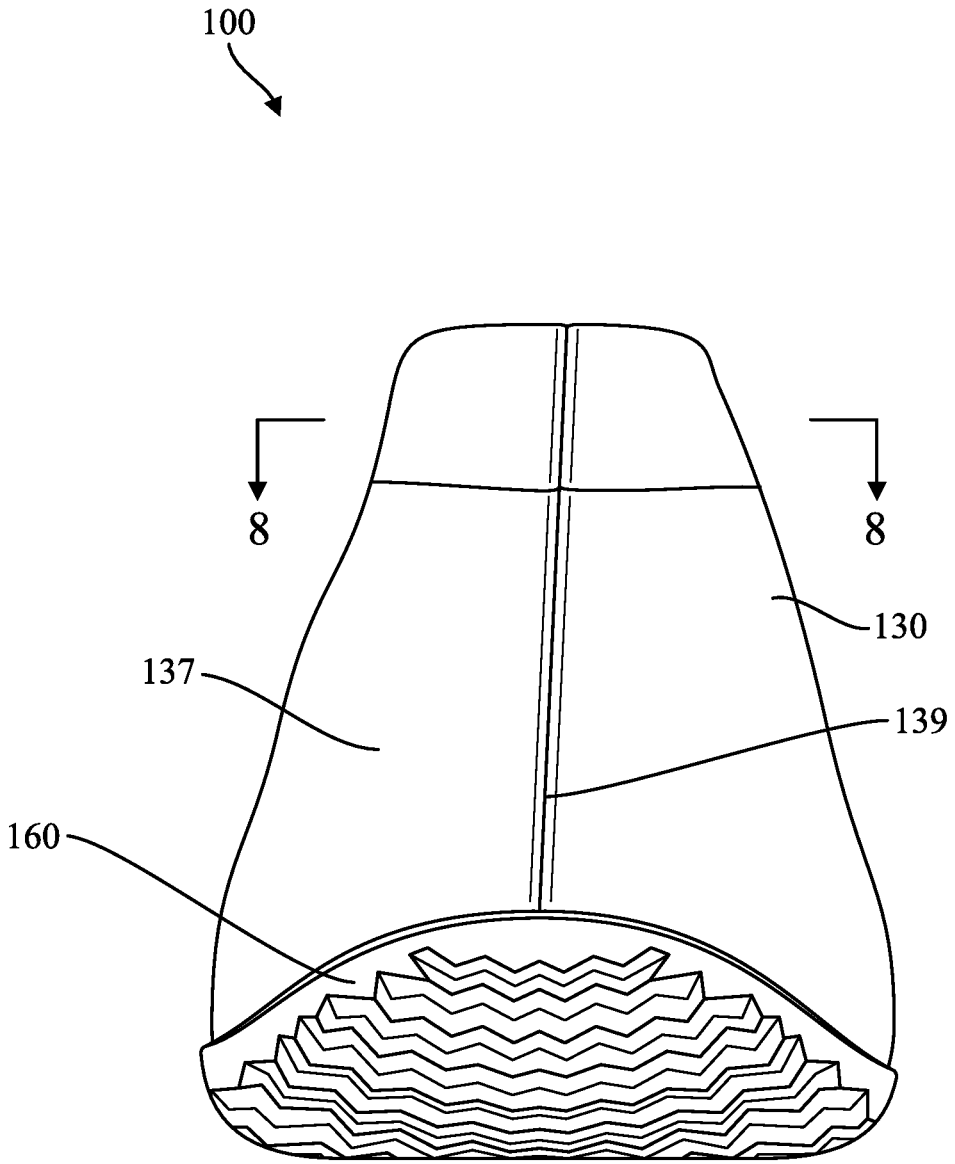
FIG. 4 shows a rear perspective view of the article of footwear of FIG. 1.

When upper 130 is secured to a bootie 110 during manufacture of article of footwear 100, medial side 136 and lateral side 138 of upper 130 are secured to one another at heel region 137. Medial and lateral sides 136, 138 may be secured to one another via a single seam 139. Seam 139 may be arranged vertically on heel region 137, as shown for example in FIG. 4. In this way, footwear 100 has a substantially seamless appearance, with only a single seam 139 at heel region 137. Medial and lateral sides 136, 138, and toe region 131 of footwear 100 have no visible seams on the exterior of footwear 100.

In some embodiments, upper 130 may be a knit upper that is formed by one or more types of yarn. In some embodiments, upper 130 may be elastic and may include elastic yarns. In some embodiments, upper 130 may include a first yarn and a second yarn. The first yarn may be an elastic yarn, and the second yarn may be a non-elastic yarn. The second yarn may be, for example, a polyester yarn. In some embodiments, upper 130 may be composed entirely of elastic yarns. Upper 130 may include one or more zones having different elasticity (see, e.g., FIG. 1). In some embodiments, upper 130 may include a first zone 132 and a second zone 134. Second zone 134 may have a greater proportion of elastic yarns than first zone 132. Second zone 134 may have greater elasticity than first zone 132 to allow for upper 130 to be pulled taut. Further, second zone 134 may provide elasticity so that upper 130 may stretch onto a lower surface of the midsole as discussed in further detail below.

Figure 5:
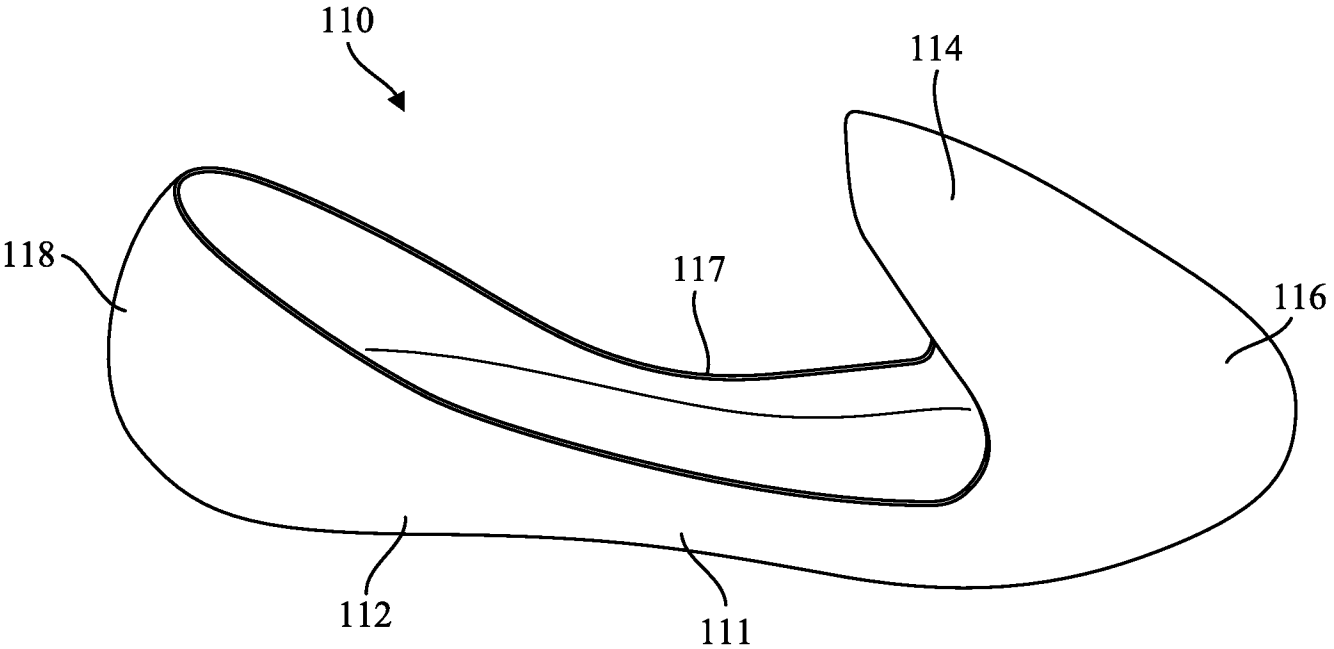
FIG. 5 shows a side perspective view of a bootie of an article of footwear according to an embodiment.

In some embodiments, footwear 100 includes a bootie 110 configured to enclose a wearer's foot, as shown in FIG. 5. Bootie 110 may have a sock-like construction. Bootie 110 may include a lower portion 112 and an upper portion 114. When bootie 110 is worn, lower portion 112 may be arranged below the wearer's foot, and upper portion 114 may at least partially cover the wearer's foot. Upper portion 114 may include a toe region 116 and a heel region 118. Toe region 116 may enclose the toes of the wearer's foot, and heel region 118 may encircle a wearer's heel. In some embodiments, bootie 110 may be substantially open at medial and lateral sides 111, 117 of bootie 110. Bootie 110 may be formed from woven, non-woven, or knit materials.

In some embodiments, bootie 110 may be formed from natural fibers or synthetic fibers, such as microfibers.

In some embodiments, upper 130 may be secured to bootie 110 by seam tape 150. Seam tape 150 may be arranged on upper portion 114 of bootie 110. Seam tape 150 may be stitched to bootie 110 to secure upper 130 to bootie 110 without applying stitches directly on upper 130. In this way, upper 130 may provide a smooth and seamless appearance on an exterior of footwear 100.

Thus, by connecting upper 130 to bootie 110, footwear 100 can be formed without the use of a Strobel board. As a result, footwear 100 may have increased flexibility relative to footwear that includes Strobel boards. Further, without a Strobel board, a wearer may better feel the cushioning provided by midsole 140, increasing comfort to the wearer.

Figure 6:
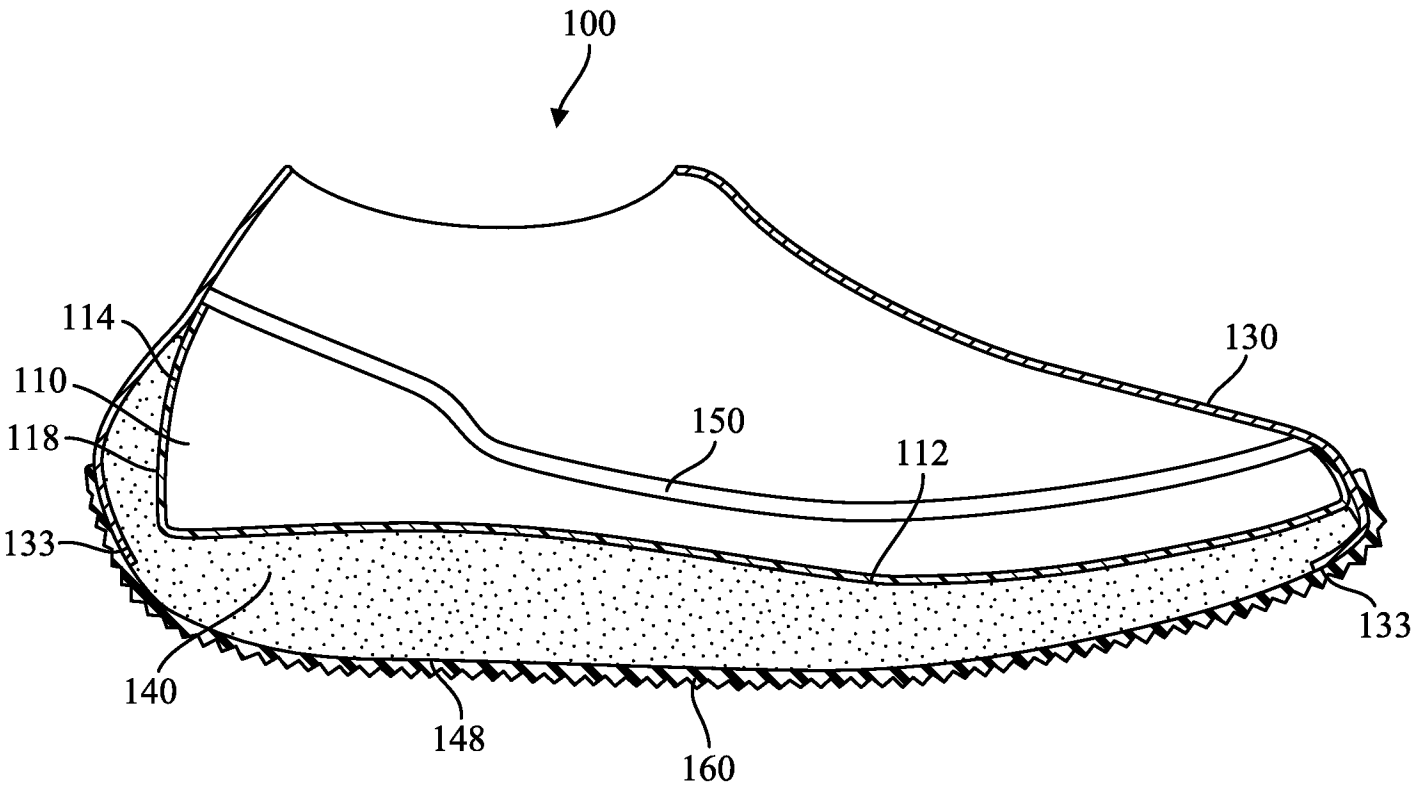
FIG. 6 shows a longitudinal cross sectional view of the article of footwear of FIG. 1 as taken along line 6-6 in FIG. 1.

Footwear 100 may further include a midsole 140, as shown for example in FIG. 6. Midsole 140 may be arranged beneath lower portion 112 of bootie 110. Midsole 140 may provide support and cushioning to the wearer's foot when footwear 100 is worn. Midsole 140 may extend from toe region 116 to heel region 118 of footwear 100. Midsole may be substantially similar in shape to lower portion 112 of bootie 110. In some embodiments, midsole 140 may extend onto upper portion 114 of bootie 110. For example, midsole 140 may extend onto heel region 118, as shown in FIG. 6. In this way, heel region 118 may be at least partially surrounded by midsole 140 to provide bootie 110, and thus the wearer's foot, with additional support and cushioning. Further, when footwear 100 is worn, the extended heel curvature provided by the portion of midsole 140 that extends onto heel region 118 may encourage a smooth transition from heel to toe strike during walking or running.

Midsole 140 may be formed from any of various materials, such as ethylene vinyl acetate (EVA), thermoplastic polyurethane (TPU), polyether block amides (PEBA), or a combination thereof. Midsole 140 may be formed by molding, such as by compression molding, transfer molding, or injection molding, among other methods. In some embodiments, midsole 140 may be die cut or additively manufactured.

Upper 130 may be arranged so as to cover at least a portion of bootie 110. It is understood that upper 130 covers an exterior surface of bootie 110 as opposing to covering an interior surface of bootie 110. However, in some embodiments, upper 130 may extend into an interior of bootie 110 so as to cover a portion of an interior surface of bootie 110. Upper 130 may cover upper portion 114 of bootie 110. In some embodiments, upper 130 may fully cover bootie 110 such that bootie 110 is not visible from an exterior of footwear 100 (see, e.g., FIG. 1). However, as upper 130 need not cover an interior surface of bootie, bootie 110 may be visible when looking inside of footwear 100, such as when looking into ankle opening of footwear 100.

In some embodiments, upper 130 may also at least partially cover midsole 140. Midsole 140 may include a sidewall 142, and upper 130 may cover a portion of sidewall 142 or may fully cover sidewall 142. Midsole 140 may include a medial sidewall 143 and a lateral sidewall 144 opposite medial sidewall 143 (see, e.g., FIG. 2). Upper 130 may cover medial sidewall 143, lateral sidewall 144, or both medial and lateral sidewalls 143, 144. Thus, when upper 130 fully covers midsole 140, midsole 140 is not visible from an exterior of footwear 100 (see, e.g., FIG. 1). This may provide footwear 100 with a unique visual appearance and may also provide footwear 100 with a smooth and uniform exterior. Upper 130 also may serve to protect or support the midsole 140 as upper 130 is the outermost layer of footwear 100. Further, upper 130 extending over midsole 140 may help to cover any creasing or imperfections in the midsole 140.

Figure 7:
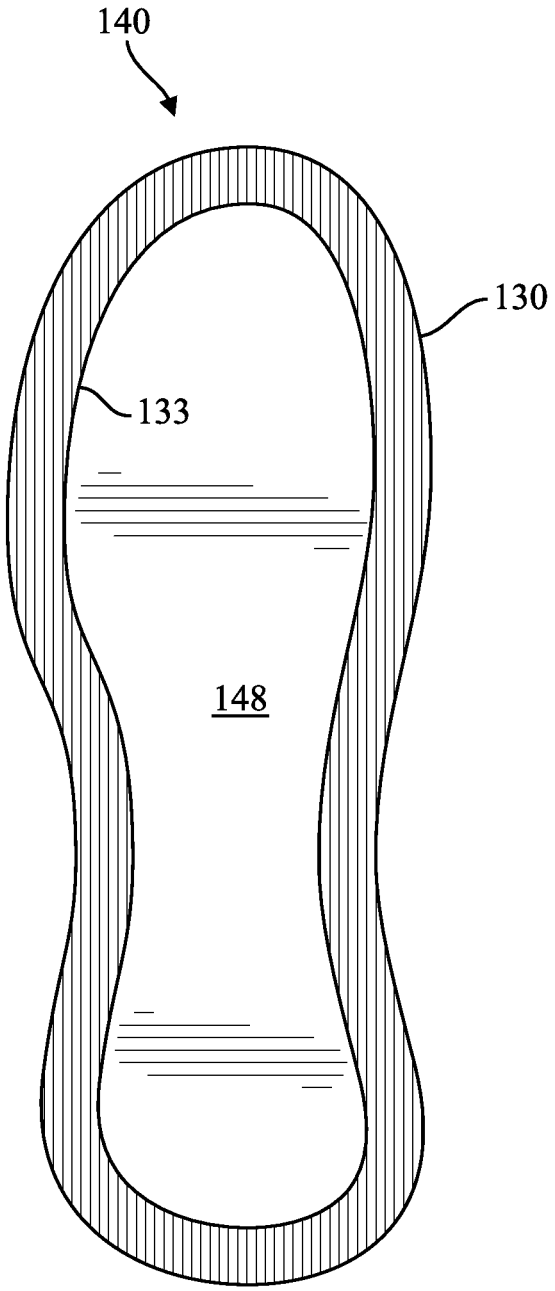
FIG. 7 shows a bottom view of a midsole of the article of footwear having a knit upper secured thereon according to an embodiment.

As upper 130 of footwear 100 is not secured to a Strobel board arranged on top of a midsole as in existing articles of footwear, upper unit 170 (i.e., bootie 110 and upper 130) of footwear 100 may be secured to midsole 140 by wrapping upper 130 around midsole 140 and securing a portion of upper 130 to a lower surface 148 of midsole 140. Specifically, upper 130 may be wrapped around sidewall 142 of midsole 140 and extend onto a lower surface 148 of midsole 140, as shown for example in FIG. 7. Thus, a perimeter edge 133 of upper 130 may be arranged on a lower surface 148 of midsole 140. In some embodiments, upper 130 may extend onto lower surface 148 of midsole 140 a distance of about 10 mm from a perimeter edge of midsole 140. In embodiments in which upper 130 includes elastic material, upper 130 may be stretched to wrap around midsole 140 and may be pulled taut. In some embodiments, excess portions of upper 130 may be cut and removed.

A portion of upper 130 extending onto lower surface 148 of midsole 140 may be secured to lower surface 148, such as by glue or adhesive. In this way, upper unit 170 including upper 130 and bootie 110 is secured to midsole 140. In some embodiments, glue or adhesive may also be applied at an interface of bootie 110 and midsole 140 to help maintain bootie 110 in place within footwear 100. Glue or adhesive may be applied, for example, at a perimeter edge of a heel portion of bootie 110 and midsole 140 to restrain movement of bootie 110 relative to midsole 140.

Figure 8:
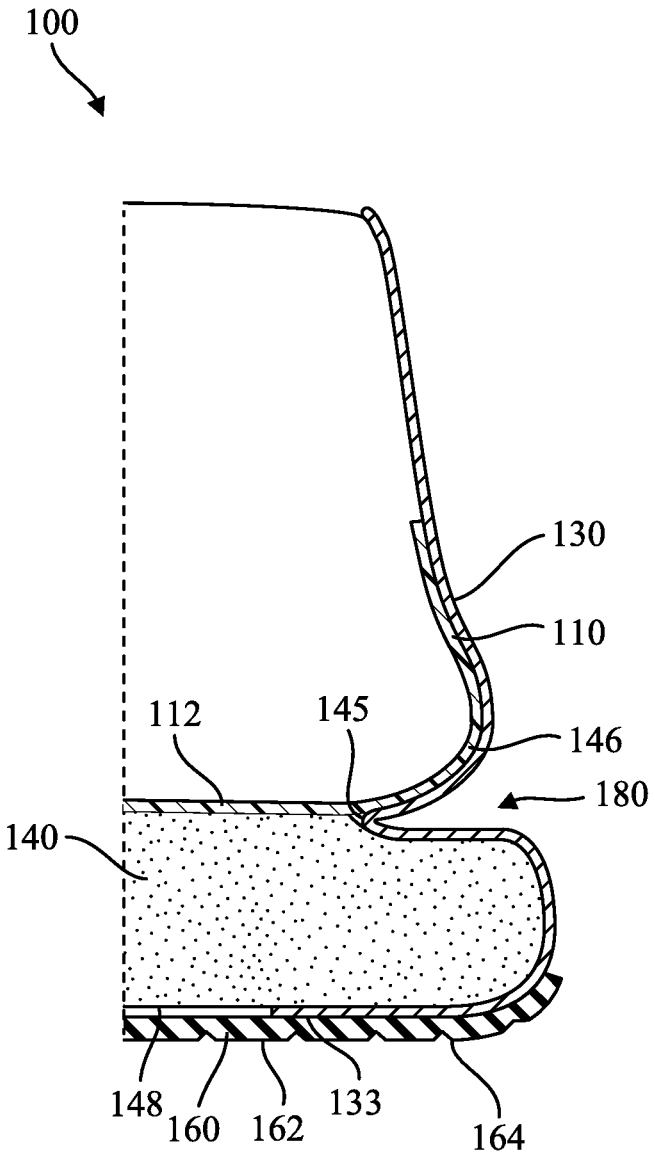
FIG. 8 shows a transverse cross sectional view of the article of footwear of FIG. 4 as taken along line 8-8 in FIG. 4.

In some embodiments, an outsole 160 may be secured to midsole 140, as shown for example in FIG. 8. As discussed, outsole 160 may serve as a ground-engaging surface of footwear 100. Outsole 160 may be secured to a lower surface 148 of midsole 140. Thus, midsole 140 may be stacked on top of outsole 160, and a portion of upper 130 may be secured between midsole 140 and outsole 160. Outsole 160 may be secured to midsole 140 by glue, adhesives, epoxies, or by bonding, among other fastening methods. Outsole 160 may be formed from rubber, such as natural rubber or synthetic rubber, including for example carbon rubber or blown rubber, among other materials, such as outsole-grade EVA. In some embodiments, a lower surface 162 of outsole 160 may include treading 164 to provide improved traction.

In some embodiments, footwear 100 may be formed with a recessed slot 180 on a medial and/or lateral side of footwear (see, e.g., FIG. 1). Recessed slot 180 may provide a unique aesthetic appearance. Recessed slot 180 may be formed by not securing midsole 140 to an entire lower surface 112 of bootie 110, such as by leaving midsole 140 unattached to bootie 110 adjacent an outer edge 146 of bootie 110, as shown for example in FIG. 8. Thus, bootie 110 may be attached to midsole 140 at a point 145 inward of outer edge 146 of bootie 110. Upper 130 may follow a contour of bootie 110 and midsole 140.

Figure 9:
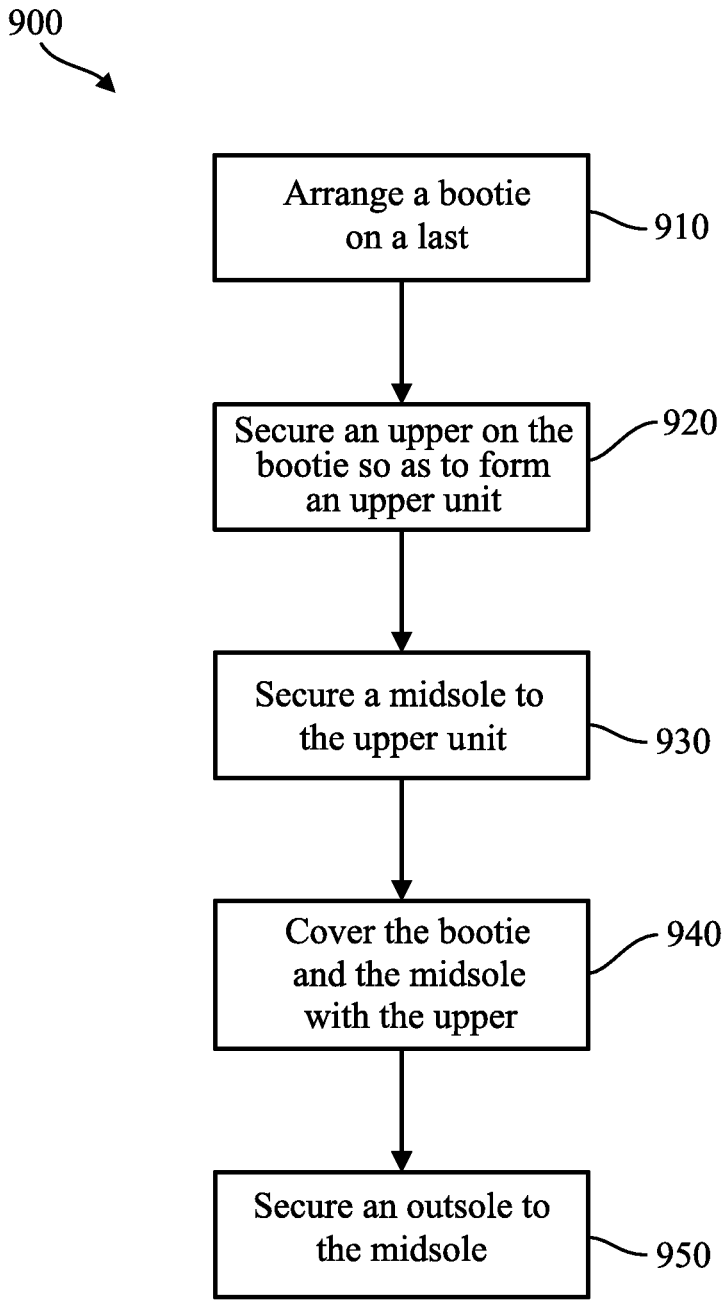
FIG. 9 shows an exemplary method of forming an article of footwear according to an embodiment.

An exemplary method of manufacturing an article of footwear 900, is shown in FIG. 9. A bootie may be arranged on a last 910. Bootie may be configured to enclose a wearer's foot and may have a sock-like construction. An upper, such as a knit upper, may be secured on the bootie 920 so as to form an upper unit. Upper may be secured to bootie, such as by seam tape. Seam tape may be stitched to the bootie such that upper does not include stitching. A midsole may be secured to the upper unit 930. In particular, midsole may be arranged beneath a lower portion of the bootie and a portion of upper may be wrapped around midsole and secured to the lower surface of the midsole to join the midsole and the upper unit. The upper may cover the bootie and the midsole 940. Upper may cover at least a portion of the bootie and at least a portion of the midsole, however, upper may fully cover bootie and/or midsole. An outsole may be secured to the midsole 950. Outsole may be secured to midsole such that a portion of upper is secured between the midsole and the outsole. The resulting article of footwear may have a single seam along a heel of the footwear for connecting opposing sides of the upper. Otherwise, footwear has a substantially seamless appearance, with no seams or dividing line on the medial and lateral sides of the footwear, or on the toe region of the footwear.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

What is claimed is:

1. An article of footwear, comprising:

a bootie configured to enclose a wearer's foot, wherein the bootie comprises a lower portion configured to be arranged below the wearer's foot, and an upper portion configured to at least partially cover the wearer's foot;

a midsole secured to the bootie;

a knit upper secured on the bootie such that the knit upper covers an exterior surface of the bootie and the midsole, wherein a portion of the midsole is arranged between the bootie and the knit upper, wherein the bootie is secured to the knit upper by seam tape arranged at the upper portion of the bootie such that there are no visible seams on an exterior of the knit upper at a medial side and a lateral side of the knit upper, and wherein the seam tape is stitched to the upper portion of the bootie such that stitches are not present on the knit upper; and an outsole secured to a lower surface of the midsole, wherein at least a portion of the knit upper is arranged between the midsole and the outsole.

2. The article of footwear of claim 1, wherein a perimeter edge of the knit upper is secured between the midsole and the outsole.

3. The article of footwear of claim 1, wherein the knit upper comprises elastic yarn.

4. The article of footwear of claim 3, wherein the knit upper comprises a first zone and a second zone each comprising elastic yarn, and wherein the first zone comprises a higher proportion of elastic yarn than the second zone.

5. The article of footwear of claim 1, wherein the midsole comprises a sidewall and a lower surface, and wherein the knit upper fully covers the sidewall of the midsole.

6. The article of footwear of claim 1, wherein the knit upper fully covers the exterior surface of the bootie.

7. The article of footwear of claim 1, wherein the bootie comprises a medial side and a lateral side, and wherein the bootie is substantially open at the medial and lateral sides.

8. The article of footwear of claim 1, wherein the knit upper comprises a single seam at a heel region of the knit upper.

9. The article of footwear of claim 1, wherein the knit upper comprises a toe region having no visible seams on the exterior of the knit upper.

10. An article of footwear, comprising:

a bootie comprising a lower portion configured to be arranged below a wearer's foot and an upper portion configured to at least partially cover the wearer's foot;

a midsole secured to the lower portion of the bootie;

a knit upper secured on the bootie by seam tape disposed on the upper portion of the bootie such that there are no visible seams on an exterior of the knit upper at a medial side and a lateral side of the knit upper, wherein the seam tape is stitched to the upper portion of the bootie, wherein the knit upper covers an exterior surface of the bootie and the midsole, and wherein a portion of the midsole is arranged between the bootie and the knit upper; and an outsole secured to the midsole, wherein the outsole is configured to serve as a ground-engaging surface, wherein the knit upper is secured between the midsole and the outsole.

11. The article of footwear of claim 10, wherein the knit upper comprises elastic yarn.

12. The article of footwear of claim 10, wherein the knit upper comprises a single seam at a heel region of the knit upper.

13. The article of footwear of claim 10, wherein the knit upper comprises a toe region having no visible seams on the exterior of the knit upper.

* * * * *